United States Patent [19]

Junghans

[11] 4,449,451

[45] May 22, 1984

[54] INKING UNIT FOR PRINTING PRESSES

[75] Inventor: Rudi Junghans, Wilhelmsfeld, Fed. Rep. of Germany

[73] Assignee: Heidelberger Druckmaschinen, Heidelberg, Fed. Rep. of Germany

[21] Appl. No.: 356,311

[22] Filed: Mar. 9, 1982

[30] Foreign Application Priority Data

Mar. 13, 1981 [DE] Fed. Rep. of Germany ..... 3109584

[51] Int. Cl.[3] ..... B41F 31/14; B41F 31/26; B41L 27/28

[52] U.S. Cl. ..... 101/350; 101/352

[58] Field of Search ..... 101/350, 351, 352, 349, 101/348, 363, 148, 206, 207, 208–210

[56] References Cited

U.S. PATENT DOCUMENTS

| | | | |
|---|---|---|---|
| 1,207,259 | 12/1916 | Wood | 101/350 |
| 1,737,628 | 12/1929 | Wood | 101/350 |
| 2,363,817 | 11/1944 | Taylor | 101/350 |
| 2,369,814 | 2/1945 | Worthington | 101/350 |
| 2,406,928 | 9/1946 | Taylor et al. | 101/350 |
| 3,563,173 | 2/1971 | Harless | 101/350 |
| 3,651,758 | 3/1972 | Harrod | 101/350 |
| 4,033,262 | 7/1977 | Johne et al. | 101/350 |
| 4,129,077 | 12/1978 | Fischer | 101/350 |
| 4,130,057 | 12/1978 | List et al. | 101/352 |

*Primary Examiner*—J. Reed Fisher

*Attorney, Agent, or Firm*—Herbert L. Lerner; Laurence A. Greenberg

[57] ABSTRACT

In an inking unit for a printing press having an ink duct with an ink-duct roller revolvable at a given speed therein, a transfer roller in rolling contact with the ink-duct roller, the transfer roller having an outer cylindrical surface formed with a plurality of helical ridges thereon, and a distributor roller revolvable at press speed greater than the given speed of the ink-duct roller, the transfer roller being rollable on the distributor roller for transporting ink film from the ink-duct roller farther into the inking unit, the improvement there including mutually meshing gear means carried by the transfer roller and the distributor roller, the transfer roller being drivable by the distributor roller via the gear means, and means for applying contact pressure of such magnitude between the transfer roller and the distributor roller during rolling of the transfer roller on the distributor roller that there is continuous contact between the surface of the distributor roller and the surface of the transfer roller located between the ridges, the ridges being in relatively low-pressure contact with the ink-duct roller revolving more slowly than the distributor roller.

7 Claims, 5 Drawing Figures

INKING UNIT FOR PRINTING PRESSES

The invention relates to an inking unit for printing presses with an ink-duct roller revolving in an ink duct, a transfer roller with several helical ridges on the outer cylindrical surface thereof and a distributor roller revolving at the speed of the printing press, the transfer roller being in rolling engagement with the distributor roller and further transporting an ink film into the inking unit.

A conventional construction of this type (German Published Non-Prosecuted Application DE-OS No. 2 062 276) discloses a transfer roller, on the outer cylindrical surface of which a multiplicity of narrow surface sections is provided, the sides of which merge helically into hollow grooves or channels. The surface sections, at the trailing side thereof as viewed in rotational direction, merge sharp-edged into the grooves. The high-speed transfer roller, with the narrow cylindrical surface sections thereof, takes up ink from the more slowly revolving ink-duct roller and transfers it to the inking unit.

A disadvantage of this heretofore known construction is that only very narrow bands of ink are transferred to the inking unit which must then be distributed over the entire surface by the rollers of the inking unit, which requires a large number of inking-unit rollers. A further marked disadvantage of the aforementioned heretofore known construction is that ink accumulates uncontrollably at the sharp trailing edges of the surface sections, for example when transfer roller and inking unit roller roll around on one another and, after the accumulated ink has reached an undefined maximum, it is surrendered completely arbitrarily and uncontrollable to the inking-unit rollers so that, in this region, an excess of ink develops resulting in variations in printing quality of the printed product. Another disadvantage of the heretofore known construction is that the transfer roller is very difficult to wash because, when changing ink, for example, each groove must be washed out manually in order to remove all traces of the old ink. It is also impossible, with the narrow surface sections, to transfer an excess of ink present in the inking unit back into the ink duct.

It is accordingly an object of the invention to provide a transfer roller in the inking unit for printing presses which, at high press speeds, transfers as expansive or areal an ink film as possible into the inking unit and returns ink from the inking unit into the ink duct, respectively, and which permits the transfer of very thin ink layers from the ink-duct roller to the inking unit.

With the foregoing and other objects in view, there is provided, in accordance with the invention, an inking unit for a printing press having an ink duct with an ink-duct roller revolvable at a given speed therein, a transfer roller in rolling contact with the ink-duct roller, the transfer roller having an outer cylindrical surface formed with a plurality of helical ridges thereon, and a distributor roller revolvable at press speed greater than the given speed of the ink-duct roller, the transfer roller being rollable on the distributor roller for transporting ink film from the ink-duct roller farther into the inking unit, the improvement therein comprising mutually meshing gear means carried by the transfer roller and the distributor roller, the transfer roller being drivable by the distributor roller via the gear means, and means for applying contact pressure of such magnitude between the transfer roller and the distributor roller during rolling of the transfer roller on the distributor roller that there is continuous contact between the surface of the distributor roller and the surface of the transfer roller located between the ridges, the ridges being in relatively low-pressure contact with the ink-duct roller revolving more slowly than the distributor roller.

An advantage of the invention is that there is a continuous, uninterrupted contact between the transfer roller and the distributor roller so that the narrow ink band or stripe accepted or received by the ridges is rolled out into a broad stripe or band of ink between both of these rollers. Also, due to the uninterrupted contact surface the transfer roller can be readily washed together with the inking unit so that no traces of old ink can collect in the recesses located between the ridges. Due to the constant contact between the transfer roller and the ink-duct roller, it is possible, furthermore, to return any excess ink from the inking unit to the ink duct so that splashing of the ink in the inking unit is reliably avoided.

The drive system for the transfer roller by means of spur gears at opposite ends thereof ensures uniform ink transfer between transfer roller and distributor roller so that the braking action of the ink-duct roller cannot have a negative effect upon the transfer roller in the form of uncontrolled slip and a stronger or weaker contact at one side thereof, respectively. A further advantage of a transfer roller having such construction is that, at the various peripheral or circumferential speeds between transfer roller and ink-duct roller, the narrow width of the ridges and the low contact pressure thereof on the ink-duct roller produces only minimal heating of the ink being transferred to the inking unit, even at maximum speed of the grass. On the other hand, due to this very contact pressure, the remaining deformations are compensated for and rendered ineffective, respectively, as a result of minimal heating.

In accordance with another feature of the invention the helical ridges are bordered by recesses formed in the outer cylindrical surface of the transfer roller and defined by a base only slightly deeper than the outer cylindrical surface and extending towards the ridges with a slight inclination, the ridges being narrow compared to the width of the recesses therebetween.

In accordance with a more specific feature of the invention, the base of the respective recesses is less than 1 mm below respective crests of the ridges.

Such a construction of the outer cylindrical surface of the transfer roller affords an uninterrupted, continuous contact between the transfer roller and the distributor roller when contact pressure between both rollers is very heavy, but on the whole, also when the contact pressure therebetween is relatively light. The flexing friction and, thereby, the generation of heat can accordingly be reduced considerably, yet enabling transfer of a continuous ink film to the inking unit.

In accordance with a further feature of the invention, the distributor roller has journals at both ends thereof, and said gear means comprise respective spur gears mounted on the journals and at both ends of the transfer roller, the spur gears of the journals respectively meshing with the spur gears of the transfer roller, and including compression spring means for pressing the respective spur gears of the distributor roller into friction contact with the distributor roller.

Due to this arrangement of spur gears at both ends of the transfer rollers and the driving thereof by respective spur gears on the journals of the distributor roller, the possibility of one-sided contact of the transfer roller due to the gear-meshing forces is reliably precluded, so that a uniformly thin ink transfer also over the length of the transfer roller is assured. The fastening of the spur gears by means of compression springs affords, when installing the transfer roller, a uniform meshing of gear teeth on both sides by simply pressing the transfer roller against the distributor roller.

In accordance with an additional feature of the invention, there is provided a spring means for pressing the transfer roller into contact with the ink-duct roller.

In accordance with an added feature of the invention, there is provided a stop means cooperating with the spring means for limiting the contact force between the transfer roller and the ink-duct roller.

In accordance with yet another feature of the invention, there is provided a means for swinging the transfer roller away from the ink-duct roller.

In accordance with yet a further feature of the invention, the transfer roller has a covering formed of elastic material having high wear-resistance.

In accordance with yet an additional feature of the invention, the elastic material has a hardness of substantially 35 to 55 Shore A.

In accordance with a concomitant feature of the invention, the helical ridges are bordered by recesses formed in the outer cylindrical surface of the transfer roller and defined by a base maximally substantially 0.2 mm below the crests of the ridges and extending towards and away from the ridges at a respective inclination and declination of substantially 6°, of 85 mm and being formed with twelve ridges disposed around the periphery of the outer cylindrical surface thereof.

The foregoing additional inventive features have been found, in extensive series of tests, to provide an advantageous construction which ensures, in a relatively simple and economical manner, reliable and optimum operation and ink transfer of the inking unit at all speeds of the printing press.

Other features which are considered as characteristic for the invention are set forth in the appended claims.

Although the invention is illustrated and described herein as embodied in inking unit for printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
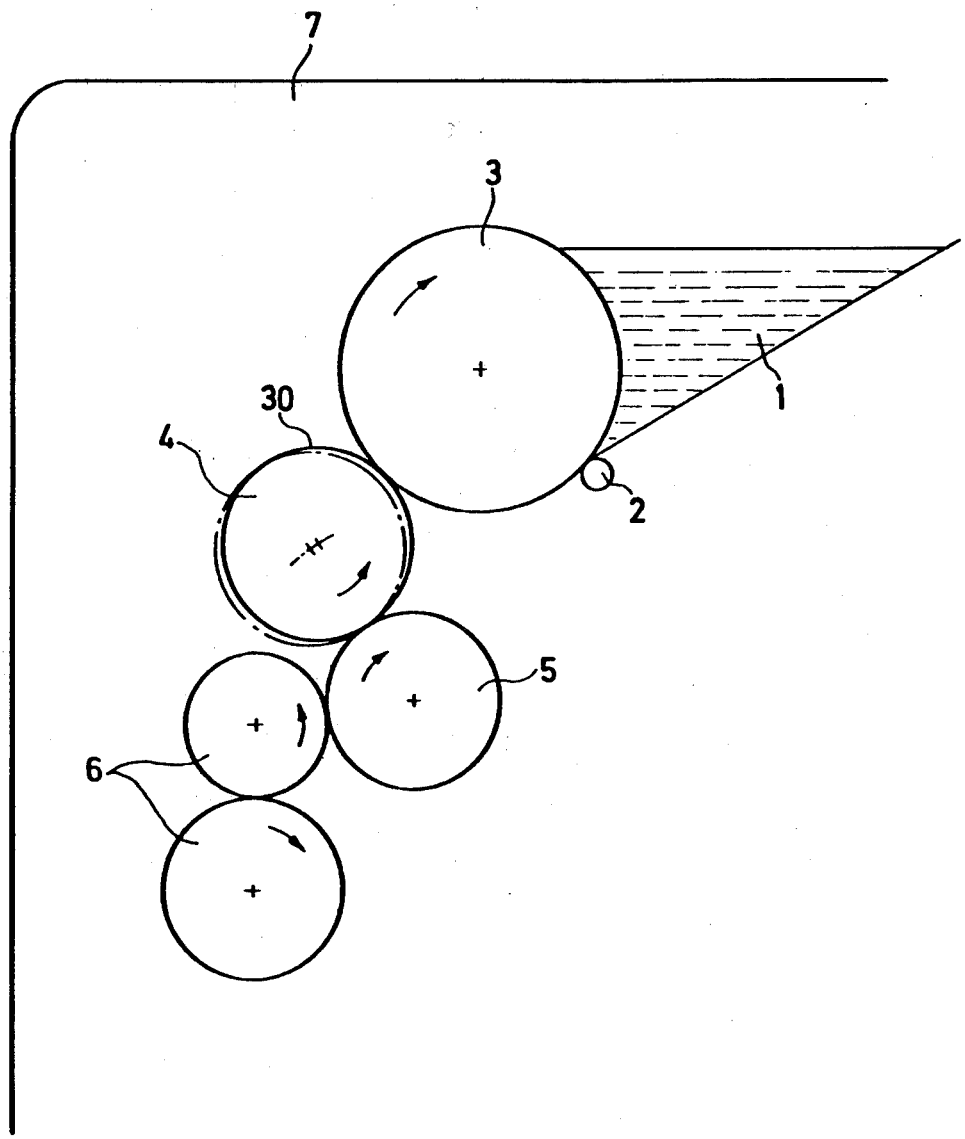
FIG. 1 is a fragmentary diagrammatic side elevational view of an inking unit constructed in accordance with the invention.

Referring now to the drawing and first, particularly to FIG. 1 thereof, there is shown an inking unit having an ink duct 1 with an ink-dosing device 2 wherein an ink duct roller 3 revolves. In contact with the ink duct roller 3 is a transfer roller 4 which is mounted so as to be pivotable about a distributor roller 5 from which an ink film is transferred over inking unit rollers 6 to a non-illustrated plate cylinder. In this construction, the ink duct roller 3 revolves at relatively low speed while the rollers 4, 5 and 6 are driven at the circumferential speed of the plate cylinder i.e. revolve at full press speed. The ink duct 1 and the successive rollers 3 to 6 are mounted at both sides or ends thereof in side frames 7 of the printing press.

Figure 2:
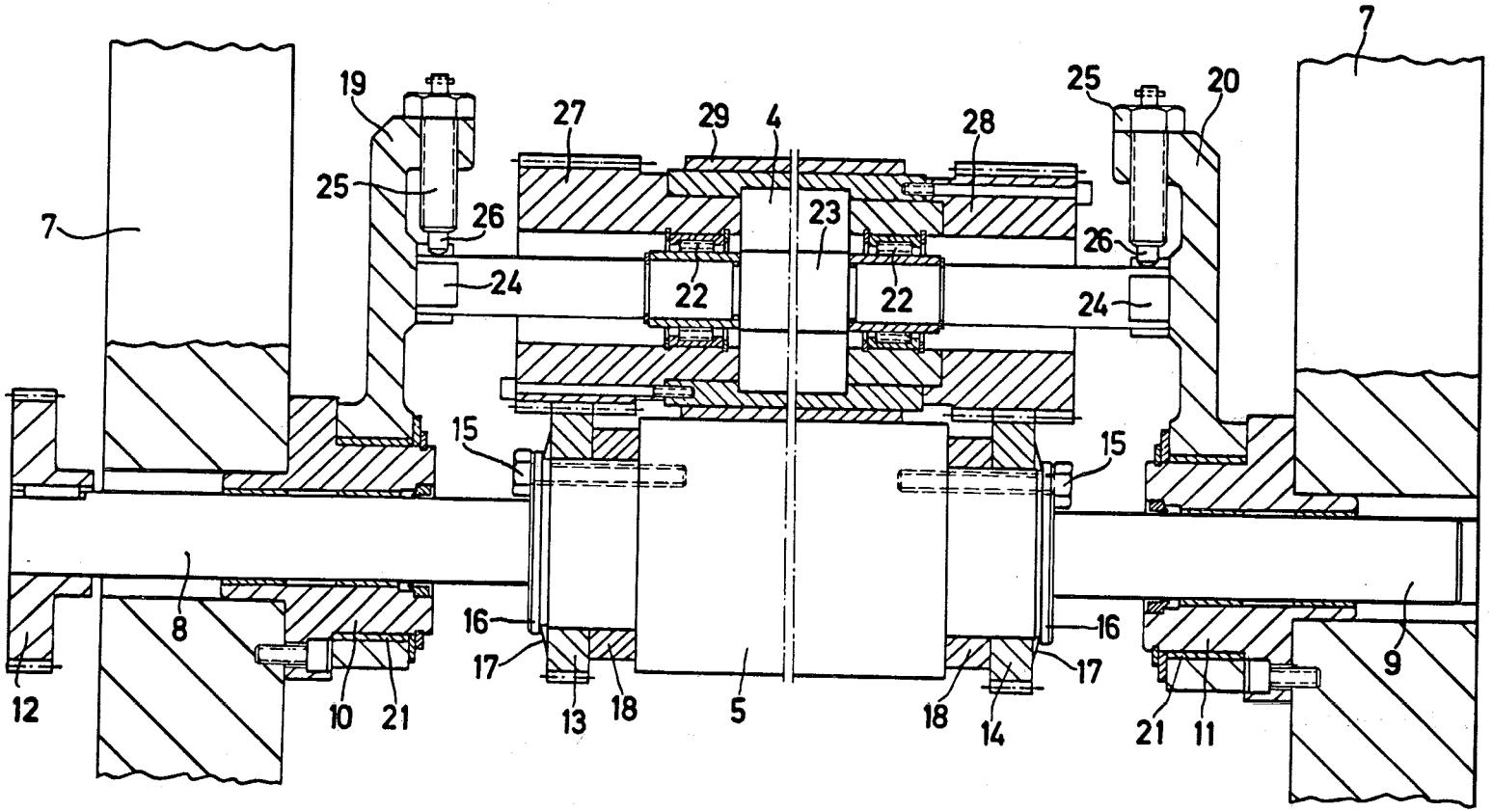
FIG. 2 is a longitudinal sectional view of a distributor roller and transfer roller according to the invention.

As shown in FIG. 2, the distributor roller 5 is revolvably mounted at both sides or ends thereof by respective journals 8, 9 thereof via bearings 10, 11 in the side frames 7. A drive gear 12 is fastened to the journal 8 outside the side frame 7. On both sides or ends of the distributor roller 5, spur gears 13,14 are mounted on the journals 8, 9 thereof and are pressed through the intermediary of an intermediate ring 18 against the end faces of the distributor roller 5 by means of bolts 15 via discs 16 and cup springs 17, so that the spur gears 13 transmit the drive forces to the transfer roller 4 by friction contact.

The transfer roller 4, in turn, is mounted in such a manner so as to be pivotable about the distributor roller 5 by means of the levers 19, 20, which are mounted via bushings 21 on the bearing supports 10, 11. The transfer roller 4 is mounted via needle bearings 22 on a non-revolving shaft 23 which is guided at both ends thereof in sliding bearings 24 in the levers 19, 20. Pressure screws 25 have a compressive spring received in the interior thereof which forces a thrust pin 26 outwardly and thereby presses the transfer roller 4 via the shaft 23 against the distributor roller 5. The contact pressure between the rollers 4 and 5 can thus be adjusted by means of the pressure screw 25.

Figure 4:
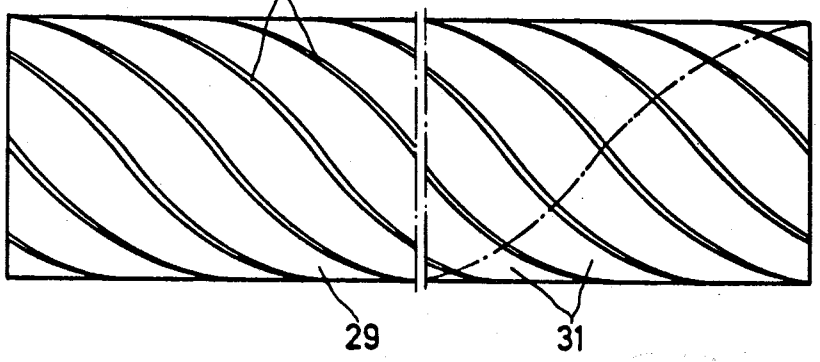
FIG. 4 is a plan view of FIG. 3.
Figure 3:
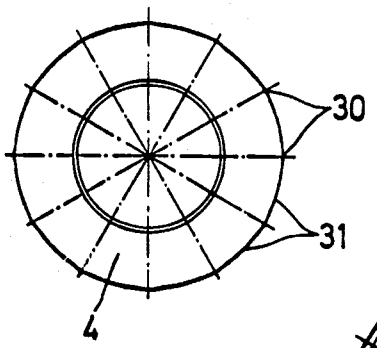
FIG. 3 is an end view of the transfer roller.
Figure 5:
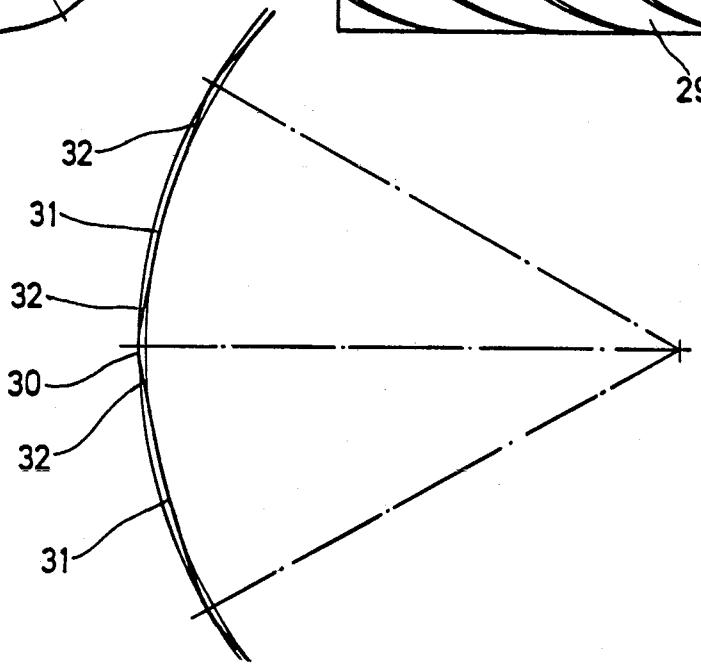
FIG. 5 is an enlarged, somewhat exaggerated diagrammatic crosssectional view of the profile of the transfer roller.

Fastened at both end faces of the transfer roller 4 are spur gears 27, 28 which mesh with the respective spur gears 13, 14 on the distributor roller 5. By simply pressing the transfer roller 4 against the distributor roller 5, the spur gears 13, 14 automatically adjust to zero clearance i.e. free of play, due to friction contact thereof. The outer cylindrical surface of the transfer roller 4 has s covering 29 formed of elastic material, for example, polyurethane—45 Shore A. This covering 29 has an outer surface provided with narrow helical ridges 30 (FIGS. 3, 4 and 5). On both sides thereof, the ridges 30 are bordered by recesses 31, the defining base of which merges with slight inclination 32 into the ridges 30 (FIG. 5). In the illustrated embodiment of the invention, the ridges 30 have been provided with a width of about 2 mm whereby the base of the recesses 31 lie 0.2 mm deeper than the ridges 30, and the inclination 32 on both sides of the ridges 30 is about 6°, with the transfer roller 4 having a diameter of 85 mm and twelve ridges on the cylindrical periphery thereof. Usually, the height of the ridges 30 is always less than 1 mm. The number of ridges 30 depends upon the maximum amount of ink to be transferred and upon the maximum layer thickness of the ink film advanced by the ductor roller, respectively.

The contact force of the springs provided in the pressure screws 25 may, in the illustrated embodiment, be limited by non-illustrated stops which are disposed on the levers 19, 20 in direction of the distributor roller 5 and, for example, by means of set screws, afford a precise adjustment of the contact force. The transfer roller 4 is also swingable away from the ink-duct roller 3 by means of the levers 19, 20, for example, for stopping the supply of ink to the inking unit. The covering 29 on the transfer roller 4 is advantageously formed of an elastic material having high resistance to wear.

With an inking unit of such construction, a constant ink transfer is attainable having good ink return with minimal heating of the ink being transferred to the inking unit and with relatively easy adjustability of the transfer roller whereby transfer of extremely thin ink layers from the ductor roller is assured, so that a precise adjustment of the amount of ink to be transferred to the inking unit and a presetting of the extent of inking can be effected in a relatively simple manner.

The foregoing is a description corresponding to German Application P 31 09 584.4, dated Mar. 13, 1981, International priority of which is being claimed for the instant application, and which is hereby made part of this application. Any discrepancies between the foregoing specification and the aforementioned corresponding German application are to be resolved in favor of the latter.

There are claimed:

1. In an inking unit for a printing press having an ink duct with an ink-duct roller revolvable at a given speed therein, a transfer roller in rolling contact with the ink-duct roller, the transfer roller having an outer cylindrical surface formed with a plurality of helical ridges thereon, a distributor roller, and means for revolving the distributor roller at press speed greater than the given speed of the ink-duct roller, the transfer roller being rollable on the distributor roller for transporting ink film from the ink-duct roller farther into the inking unit, the improvement therein comprising mutually meshing gear means carried by the transfer roller and the distributor roller, the transfer roller being drivable by the distributor roller via said gear means, and means for applying yielding contact pressure of such magnitude between the transfer roller and the distributor roller during rolling of the transfer roller on the distributor roller that there is continuous contact between the surface of the distributor roller and the surface of the transfer roller located between the ridges, the ridges being in relatively low-pressure contact with the ink-duct roller revolving more slowly than the distributor roller, the ridges are bordered by recesses formed in the outer cylindrical surface of the transfer roller and defined by a cylindrical base coaxial with the outer cylindrical surface and only slightly deeper than the outer cylindrical surface, the helical ridges being formed by surface portions of the transfer roller extending from said cylindrical base with a slight inclination from opposite sides towards an apex, the ridges being narrow compared to the width of the recesses therebetween.

2. Inking unit according to claim 1 wherein the base of the respective recesses is less than 1 mm below respective crests of the ridges.

3. Inking unit according to claim 1 wherein the distributor roller has journals at both ends thereof, and said gear means comprise respective spur gears mounted on said journals and at both ends of the transfer roller, the spur gears of said journals respectively meshing with the spur gears of the transfer roller, and including compression spring means for pressing the respective spur gears of the distributor roller into friction contact with the distributor roller.

4. Inking unit according to claim 1 including means for swinging the transfer roller away from the ink-duct roller.

5. Inking unit according to claim 1 wherein the transfer roller has a covering formed of elastic material having high wear-resistance.

6. Inking unit according to claim 5 wherein said elastic material has a hardness of substantially 35 to 55 Shore A.

7. Inking unit according to claim 1 wherein the helical ridges are bordered by recesses formed in the outer cylindrical surface of the transfer roller and defined by a base maximally 0.2 mm below the crests of the ridges and extending towards and away from the ridges at a respective inclination and declination of substantially 6°, the transfer roller having a cross-sectional diameter of 85 mm and being formed with twelve ridges disposed around the periphery of the outer cylindrical surface thereof.

* * * * *